US007683545B2

(12) United States Patent
Kwon et al.

(10) Patent No.: US 7,683,545 B2
(45) Date of Patent: Mar. 23, 2010

(54) PLASMA DISPLAY PANEL COMPRISING COMMON BARRIER RIB BETWEEN NON-DISCHARGE AREAS

(75) Inventors: Jae-Ik Kwon, Suwon-si (KR); Hye-Kyong Kwon, Suwon-si (KR); Tae-Kyoung Kang, Suwon-si (KR); Eun-Gi Heo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 550 days.

(21) Appl. No.: 10/999,231

(22) Filed: Nov. 29, 2004

(65) Prior Publication Data

US 2005/0134176 A1 Jun. 23, 2005

(30) Foreign Application Priority Data

Nov. 29, 2003 (KR) ..... 10-2003-0086144

(51) Int. Cl.
*H01J 17/49* (2006.01)

(52) U.S. Cl. ..... 313/583; 313/582; 313/584; 313/586; 315/169.1

(58) Field of Classification Search ..... 313/582–587; 315/169.1, 169.4; 345/37, 41, 60, 71
See application file for complete search history.

(56) References Cited

U.S. PATENT DOCUMENTS 5,640,068 A 6/1997 Amemiya
5,661,500 A 8/1997 Shinoda et al.
5,952,782 A 9/1999 Nanto et al.
6,031,329 A 2/2000 Nagano
6,200,182 B1 3/2001 Nanto et al.
6,249,264 B1 6/2001 Sano et al.

(Continued)

FOREIGN PATENT DOCUMENTS

CN 1154528 A 7/1997

(Continued)

OTHER PUBLICATIONS

Patent Abstract of Japan, Publication No. 10 (1998)-149771, Published on Jun. 2, 1998, in the name of Yatsuda, et al.

(Continued)

*Primary Examiner*—Sikha Roy
*Assistant Examiner*—Jose M Diaz
(74) *Attorney, Agent, or Firm*—Christie, Parker & Hale, LLP

(57) ABSTRACT

A plasma display panel includes a first substrate, on which discharge sustain electrodes are formed, and an opposing second substrate, on which address electrodes are aligned in a first direction. Barrier ribs between the substrates define a plurality of discharge cells within which phosphor layers are formed. The display electrodes have bus electrodes, forming a corresponding pair within each of the discharge cells, and extension electrodes, extending from the bus electrodes into each of the discharge cells to form an opposing pair. A pair of the display electrodes corresponding to each of the discharge cells forms a first gap and a second gap having different distances from each other between the opposing extension electrodes, and forms a third gap between the bus electrodes. The second gap is longer than the first gap, and the third gap is longer than the second gap.

21 Claims, 13 Drawing Sheets

U.S. PATENT DOCUMENTS

| | | | | |
|---|---|---|---|---|
| 6,288,488 | B1 | 9/2001 | Amemiya | |
| 6,373,195 | B1 | 4/2002 | Whang et al. | |
| 6,376,986 | B1 * | 4/2002 | Takagi et al. | 313/582 |
| 6,424,095 | B1 | 7/2002 | Hirao et al. | |
| 6,479,932 | B1 | 11/2002 | Nunomura | |
| 6,495,957 | B2 | 12/2002 | Kurogi et al. | |
| 6,498,593 | B1 | 12/2002 | Fujimoto et al. | |
| 6,504,519 | B1 | 1/2003 | Ryu et al. | |
| 6,522,072 | B1 * | 2/2003 | Yura et al. | 313/582 |
| 6,577,061 | B2 | 6/2003 | Sano et al. | |
| 6,603,263 | B1 | 8/2003 | Hashimoto et al. | |
| 6,608,441 | B2 * | 8/2003 | Kunii et al. | 313/584 |
| 6,630,788 | B1 | 10/2003 | Park | |
| 6,639,363 | B2 | 10/2003 | Amatsuchi et al. | |
| 6,646,377 | B2 | 11/2003 | Hashimoto | |
| 6,657,386 | B2 | 12/2003 | Koshio et al. | |
| 6,670,754 | B1 | 12/2003 | Murai et al. | |
| 6,674,238 | B2 * | 1/2004 | Otani et al. | 313/587 |
| 6,700,323 | B2 | 3/2004 | Amemiya | |
| 6,703,772 | B2 | 3/2004 | Hasegawa et al. | |
| 6,707,259 | B2 * | 3/2004 | Nagao et al. | 315/169.4 |
| 6,727,869 | B1 | 4/2004 | Kosaka | |
| 6,774,558 | B2 | 8/2004 | Otani et al. | |
| 6,819,046 | B2 * | 11/2004 | Hirano | 313/582 |
| 7,088,314 | B2 | 8/2006 | Harada et al. | |
| 7,136,033 | B2 | 11/2006 | Kim et al. | |
| 7,166,960 | B2 | 1/2007 | Kim et al. | |
| 7,208,875 | B2 | 4/2007 | Kwon et al. | |
| 7,208,876 | B2 * | 4/2007 | Kang et al. | 313/582 |
| 7,230,379 | B2 | 6/2007 | Kwon et al. | |
| 7,365,712 | B2 | 4/2008 | Yi | |
| 2001/0026130 | A1 * | 10/2001 | Amemiya et al. | 313/586 |
| 2002/0000779 | A1 | 1/2002 | Anders | |
| 2002/0021090 | A1 | 2/2002 | Sano et al. | |
| 2002/0047519 | A1 * | 4/2002 | Kunii et al. | 313/584 |
| 2002/0063510 | A1 | 5/2002 | Yura et al. | |
| 2003/0080682 | A1 | 5/2003 | Nagano | |
| 2003/0146713 | A1 * | 8/2003 | Nagao et al. | 315/169.4 |
| 2003/0193487 | A1 | 10/2003 | Yatsuda et al. | |
| 2004/0051457 | A1 | 3/2004 | Kimura et al. | |
| 2004/0085264 | A1 | 5/2004 | Takada et al. | |
| 2004/0113555 | A1 * | 6/2004 | Han et al. | 313/586 |
| 2004/0135509 | A1 * | 7/2004 | Kwon et al. | 313/584 |
| 2004/0201350 | A1 * | 10/2004 | Kwon et al. | 313/582 |
| 2004/0234902 | A1 | 11/2004 | Toyoda et al. | |
| 2005/0052137 | A1 | 3/2005 | Kwon et al. | |
| 2005/0088094 | A1 * | 4/2005 | Kim et al. | 313/583 |
| 2005/0212430 | A1 * | 9/2005 | Ahn et al. | 313/587 |
| 2007/0114933 | A1 | 5/2007 | Kim et al. | |

FOREIGN PATENT DOCUMENTS

| | | | |
|---|---|---|---|
| CN | 1264914 | | 8/2000 |
| CN | 1267877 | | 9/2000 |
| CN | 1327253 | | 12/2001 |
| CN | 1337665 | | 2/2002 |
| CN | 1344005 | | 4/2002 |
| CN | 1397976 | | 2/2003 |
| EP | 0 920 048 | A2 | 6/1999 |
| EP | 1 263 014 | A1 | 12/2002 |
| JP | 4-298936 | | 10/1992 |
| JP | 5-94772 | | 4/1993 |
| JP | 6-44907 | | 2/1994 |
| JP | 6-342631 | | 12/1994 |
| JP | 7-65728 | | 3/1995 |
| JP | 10 (1998)-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-31460 | | 2/1999 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-82407 | | 3/2000 |
| JP | 2000-113828 | | 4/2000 |
| JP | 2000-187200 | | 7/2000 |
| JP | 2000-195431 | | 7/2000 |
| JP | 2000-228150 | | 8/2000 |
| JP | 2000-323045 | | 11/2000 |
| JP | 2000-357459 | | 12/2000 |
| JP | 2001-126628 | | 5/2001 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-93327 | | 3/2002 |
| JP | 2002-190256 | | 7/2002 |
| JP | 2002-197981 | | 7/2002 |
| JP | 2002-203487 | | 7/2002 |
| JP | 2002-216642 | | 8/2002 |
| JP | 2002-231146 | | 8/2002 |
| JP | 2002-245943 | | 8/2002 |
| JP | 2002-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-051258 | | 2/2003 |
| JP | 2003-68212 | | 3/2003 |
| JP | 2003-68215 | | 3/2003 |
| JP | 2003-086106 | | 3/2003 |
| JP | 2003-132805 | | 5/2003 |
| JP | 2003-157773 | | 5/2003 |
| JP | 2003-303550 | | 10/2003 |
| JP | 2003-303551 | | 10/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 1020030042538 | A * | 2/2003 |
| KR | 2003-0033658 | | 5/2003 |
| KR | 10-2003-0042538 | | 6/2003 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |
| WO | WO00/46832 | | 8/2000 |

OTHER PUBLICATIONS

Patent Abstracts of Japan, Publication No. 2003-157773, dated May 30, 2003, in the name of Tomohiro Kimura et al.

Korean Patent Abstracts for Publication No. 1020030033658; Date of publication of application May 1, 2003, in the name of Gwang Yeol Choi.

U.S. Appl. No. 10/746,540, filed Dec. 23, 2003, Kwon, et al.

Patent Abstracts of Japan for Publication No. 04-298936; Date of publication of application Oct. 22, 1992, in the name of T. Okajima.

Patent Abstracts of Japan, Publication No. 05-094772; Publication Date: Apr. 16, 1993; in the name of Noborio.

Patent Abstracts of Japan, Publication No. 07-065728, dated Mar. 10, 1995, in the name of Tatsutoshi Kanae et al.
Patent Abstracts of Japan for Publication No. 10-283934; Date of publication of application: Oct. 23, 1998, in the name of Tsutomu Tokunaga et al.
Patent Abstracts of Japan for Publication No. 10-308179, Date of publication of application Nov. 17, 1998, in the name of K. Aoto et al.
Patent Abstracts of Japan, Publication No. 10-334811; Publication Date: Dec. 18, 1998; in the name of Aoki et al.
Patent Abstracts of Japan, Publication No. 11-031460, dated Feb. 2, 1999, in the name of Takaaki Murata et al.
Patent Abstracts of Japan, Publication No. 11-096921; Publication Date: Apr. 9, 1999; in the name of Tomioka et al.
Patent Abstracts of Japan, Publication No. 11-317170; Publication Date: Nov. 16, 1999; in the name of Kado et al.
Patent Abstracts of Japan for Publication No. 11-345570; Date of publication of application: Dec. 14, 1999, in the name of Takaaki Murata et al.
Patent Abstracts of Japan for Publication No. 2000-011899; Date of publication of application: Jan. 14, 2000, in the name of Kimio Amamiya.
Patent Abstracts of Japan for Publication No. 2000-021313; Date of publication of application: Jan. 21, 2000, in the name of Kenji Yoshida et al.
Patent Abstracts of Japan, Publication No. 2000-082407, dated Mar. 21, 2000, in the name of Toshihiro Komaki et al.
Patent Abstracts of Japan, Publication No. 2000-113828, dated Apr. 21, 2000, in the name of Masaki Kuroki et al.
Patent Abstracts of Japan for Publication No. 2000-323045; Date of publication of application: Nov. 24, 2000, in the name of Kazuki Takagi et al.
Patent Abstracts of Japan for Publication No. 2001-283734; Date of publication of application: Oct. 12, 2001, in the name of Sukeyuki Nishimura et al.
Patent Abstracts of Japan, Publication No. 2002-093327, dated Mar. 29, 2002, in the name of Masaki Aoki et al.
Patent Abstracts of Japan for Publication No. 2002-373593; Date of publication of application: Dec. 26, 2002, in the name of Hiroshi Kanda.
Patent Abstract of Japan, Publication No. 2001-345054, Published on Dec. 14, 2001, in the name of Sano, et al.
Patent Abstract of Japan, Publication No. 2002-231146, Published on Aug. 16, 2002, in the name of Yura, et al.
European Patent Office Search Report, dated Feb. 3, 2005, for application No. 04090020.1, in the name of Samsung SDI Co., Ltd.
Korean Patent Abstracts for publication No. 1020030061079, with a date of publication of Jul. 18, 2003, in the name of Y. Ahn et al.
Korean Patent Abstracts for publication No. 1020010093724, with a date of publication of Oct. 29, 2001, in the name of K. Morikawa et al.
Korean Patent Abstracts for publication No. 1020040032508, with a date of publication of Apr. 17, 2004, in the name of B. Lee.
Patent Abstracts of Japan for publication No. 2001-210241, with a date of publication of Aug. 3, 2001, in the name of T. Kosaka.
Patent Abstracts of Japan for publication No. 2002-083545, with a date of publication of Mar. 22, 2002, in the name of Y. Kunii et al.
Patent Abstracts of Japan for publication No. 2000-195431, with a publication date of Jul. 14, 2000, in the name of T. Komaki et al.
Patent Abstracts of Japan for publication No. 2003-303551, with a publication date of Oct. 24, 2003, in the name of S. Kan.
Patent Abstracts of Japan for publication No. 2003303550, with a publication date of Oct. 24, 2003, in the name of S. Kan.
Patent Abstracts of Japan, Publication No. 2002-190256, Date of Publication Jul. 5, 2002, in the name of Takada, et al.
Korean Patent Abstracts for Publication No. 1020010062222, publication date of Jul. 7, 2001, in the name of K. Amemiya et al.
Patent Abstracts of Japan for Publication No. 2002-245943, publication date of Aug. 30, 2002, in the name of K. Morikawa et al.
Korean Patent Abstracts for Publication No. 1019990065408A, publication date of Aug. 5, 1999, in the name of S. Lee.
Patent Abstracts of Japan for Publication No. 2001-160361; Date of publication of application Jun. 12, 2001, in the name of S. Yura et al.
Patent Abstracts of Japan for Publication No. 2002-324488; Date of publication of application Nov. 8, 2002, in the name of N. Hirano et al.
Patent Abstracts of Japan, Publication No. 2000-042661; Publication Date: Feb. 15, 2000; in the name of Arima et al.
Patent Abstracts of Japan, Publication No. 2000-357459; Publication Date: Dec. 26, 2000; in the name of Jae et al.
Patent Abstracts of Japan, Publication No. 2002-260537; Publication Date: Sep. 13, 2002; in the name of Ito et al.
Patent Abstracts of Japan, Publication No. 06-342631, Published Dec. 13, 1994 in the name of Noborio.
Patent Abstracts of Japan, Publication No. 10-269951, Published Oct. 9, 1998 in the name of Fumihiro.
Patent Abstracts of Japan, Publication No. 11-213893, Published Aug. 6, 1999 in the name of Toshie et al.
Patent Abstracts of Japan, Publication No. 2000-187200, Published Jul. 4, 2000 in the name of Pascale et al.
Patent Abstracts of Japan, Publication No. 2002-025451, Published Jan. 25, 2002 in the name of Toshihiko et al.
Patent Abstracts of Japan, Publication No. 2002-197981, Published Jul. 12, 2002 in the name of Toshihiro et al.
Patent Abstracts of Japan, Publication No. 2003-016944, Published Jan. 17, 2003 in the name of Kimio.
Patent Abstracts of Japan, Publication No. 2003-031130, Published Jan. 31, 2003 in the name of Eishiro et al.
Patent Abstracts of Japan, Publication No. 2003-068212, Published Mar. 7, 2003 in the name of Naoki et al.
Patent Abstracts of Japan, Publication No. 2003-068215, Published Mar. 7, 2003 in the name of Shuichi et al.
Patent Abstracts of Japan, Publication No. 2003-132805. Published May 9, 2003 in the name of Tomohiro et al.
Patent Abstract of Japan, Publication No. 2004-164885, Published Jun. 10, 2004 in the name of Takashi et al.
Patent Abstracts of Japan Publication No. 2002-203487 dated Jul. 19, 2002 in the name of S. Shiromizu.
Patent Abstracts of Japan, Publication No. 6-044907, dated Feb. 18, 1994, in the name of Tetsuji Okajima.
Korean Utility Model Abstracts for Publication No. 2019980030878; Date of Publication of application Aug. 17, 1998, in the name of B. Choi.
Korean Patent Abstracts for Publication No. 1020020036012; Date of publication of application May 16, 2002, in the name of U. Kim.
Korean Patent Abstracts, Publication No. 1020010016651 A; Publication Date: Mar. 5, 2001; in the name of Park.
Korean Patent Abstracts, Publication No. 1020020055807 A; Publication Date: Jul. 10, 2002; in the name of Kim.
Korean Patent Abstracts, Publication No. 1020030042538 A; Publication Date: Jun. 2, 2003; in the name of Min.
English translation for KR 10-2003-0042538 A, dated Jun. 2, 2003, listed above.
Korean Patent Abstracts, Publication No. 1020030044667 A; Publication Date: Jun. 9, 2003; in the name of Lee.
U.S. Office action dated Aug. 22, 2008, for related U.S. Appl. No. 10/929,626, indicating relevance of references listed in this IDS.
Patent Abstracts of Japan, Publication No. 2000-228150, dated Aug. 15, 2000, in the name of Naoto Hirano et al.
Patent Abstracts of Japan, Publication No. 2001-126628, dated May 11, 2001, in the name of Takahiro Torisaki et al.
Patent Abstracts of Japan, Publication No. 2002-216642, dated Aug. 2, 2002, in the name of Kiyoshi Chiyoda et al.
Patent Abstracts of Japan, Publication No. 2003-051258, dated Feb. 21, 2003, in the name of Keisuke Sumita et al.
Patent Abstracts of Japan, Publication No. 2003-086106, dated Mar. 20, 2003, in the name of Hiroshi Mori et al.
U.S. Office action dated Jan. 28, 2009, for related U.S. Appl. No. 10/929,626, indicating relevance of listed references in this IDS.
U.S. Notice of Allowance dated Mar. 3, 2009, for related U.S. Appl. No. 10/871,427.

* cited by examiner

PLASMA DISPLAY PANEL COMPRISING COMMON BARRIER RIB BETWEEN NON-DISCHARGE AREAS

CROSS REFERENCE TO RELATED APPLICATION

This application claims priority to and the benefit of Korean Patent Application number 10-2003-0086144, filed Nov. 29, 2003, the entire disclosure of which is incorporated herein by reference.

BACKGROUND OF THE INVENTION (a) Field of the Invention

The present invention relates to a plasma display panel (hereinafter, PDP), and more particularly, to a surface discharge type PDP with an electrode structure in which a pair of display electrodes are formed on one substrate and have a corresponding pair of bus electrodes within each discharge cell between two substrates to cause a display discharge.

(b) Description of the Related Art

Generally, a plasma display panel is a display device in which ultraviolet rays generated by gas discharge excite phosphors to realize predetermined images. Such a plasma display panel is popular for wide screen display devices since it enables the manufacture of large screen sizes with high resolution.

Referring to FIG. 8, a generally known PDP is formed with address electrodes 112 along one direction (in the X-axis direction of the drawing) on a rear substrate 110, and a dielectric layer 113 is formed on an entire surface of the rear substrate 110 covering the address electrodes 112. On the dielectric layer 113, barrier ribs 115 of a stripe pattern are formed and placed between each of the address electrodes 112, and red (R), green (G), blue (B) phosphor layers 117 are formed on each of the barrier ribs 115.

In addition, display electrodes 102, 103 having a pair of transparent electrodes 102*a*, 103*a* and bus electrodes 102*b*, 103*b* are formed along the direction crossing the address electrodes 112 (in the Y-axis direction of the drawing) on a surface of a front substrate 100 opposing the rear substrate 110. A transparent dielectric layer 106 and a MgO protection film 108 are formed covering the display electrodes on a surface of the front substrate 100.

The region where the address electrodes 112 on the rear substrate 110 are intersected with the display electrodes 102, 103 on the front substrate 100 is to be a portion where discharge cells are formed.

An address voltage Va is applied between the address electrodes 112 and the display electrodes 102, 103 to cause address discharge, and a sustain voltage Vs is applied to a pair of the display electrodes 102, 103 to cause sustain discharge. Then, the generated vacuum ultraviolet rays excite phosphors so that they emit visible light through the front substrate 100 and thereby display PDP images.

However, the PDP having the discharge electrodes 102, 103 and the barrier ribs 115 in a stripe formation as shown in FIG. 8, may cause crosstalk between the discharge cells adjacent with the barrier ribs 115. In addition, it may cause the misdischarge between the adjacent discharge cells since the discharge areas are connected to one another along the direction where the barrier ribs 115 are formed. In order to prevent these problems, the distance between the display electrodes 102, 103 corresponding to the adjacent pixels needs to be over a certain level, which reduces improvements in efficiency.

To solve the above problems, PDPs having improved electrodes and barrier ribs as shown in FIG. 9 have been suggested. The PDP has a configuration such that transparent electrodes 123*a* of display electrodes 123 are extended from bus electrodes 123*b* to face each other in a pair within each of the discharge cells. For the purpose of reducing the crosstalk between the adjacent discharge cells and enhancing the emission efficiency by increasing the phosphor coated area, a PDP is suggested which has barrier ribs 125 of the matrix type formed with vertical barrier ribs 125*a* and horizontal barrier ribs 125*b* perpendicular to each other. Japanese Patent Laid-open No. 1998-149771 describes such a plasma display panel.

A PDP is a display using gas discharge, and its emission efficiency can be varied according to the amount of the excited atoms generated. The emission efficiency is known to increase with increasing total or partial pressure of sealed discharge gases.

If total or partial pressure is increased to improve the efficiency, the breakdown voltage necessarily increases and the discharge instability increases. Sometimes the discharge itself does not take place, and the use of high pressure resistant devices causes an increase in the unit cost of a circuit.

In an effort to lower the breakdown voltage in such a PDP, a gap between discharge electrodes can be decreased when designing discharge electrodes. However, simply decreasing the gap between discharge electrodes may cause several problems.

One problem arising when this gap is decreased is that the discharge path is decreased, thereby deteriorating the emission efficiency of panel. Furthermore, if the gap between discharge electrodes is decreased below a certain value, the breakdown voltage is increased. As shown in the Paschen curve of FIG. 10, if the discharge gas temperature multiplied by the distance between the electrodes (p·d value) becomes lower than a certain value (the minimum value), the Vf voltage value along the Y axis can increase. Accordingly, a decrease in breakdown voltage is needed by properly designing electrodes.

Another problem which can occur when the gap between the discharge electrodes is decreased is related to insulation resistance of dielectric substances. If the gap between the discharge electrodes is decreased, a strong magnetic field is generated between two electrodes and then the possibility of destruction of insulation between the electrodes is increased. It therefore becomes necessary to improve the insulating resistance. Accordingly, these factors must be considered when designing the discharge electrodes.

FIGS. 11*a* and 11*b* show a plan view of conventional discharge cells and a light profile graph for sustain discharge in a conventional PDP.

FIG. 11*b* shows the light emission from the portion within the dotted line in FIG. 11*a* along the vertical direction (the direction parallel to barrier ribs). Although the bus electrodes supply a voltage, they also have an adverse effect of shielding the visible light generated from a discharge space as shown in FIG. 11*b*, since the bus electrodes are positioned at the discharge space. Accordingly, this causes the deterioration of the brightness and the emission efficiency.

SUMMARY OF THE INVENTION

According to one aspect of the present invention, there is provided a PDP in which emission efficiency is maximized by an efficient layout and design of the electrodes, and the circuit unit cost is decreased by lowering breakdown voltage, thereby improving the quality.

According to one exemplary embodiment of the present invention, the plasma display panel includes a first substrate and a second substrate opposing each other; address electrodes formed on the second substrate; barrier ribs arranged in the space between the first substrate and the second substrate to define a plurality of discharge cells; phosphor layers formed within each of the discharge cells; and display electrodes formed on the first substrate. The display electrodes have bus electrodes, which extend along the direction intersecting the direction of the address electrodes to form a corresponding pair within each of the discharge cells, and extension electrodes, which extend from the bus electrodes into each of the discharge cell to form an opposing pair. A pair of the display electrodes corresponding to each of the discharge cells forms a first gap G1 and a different, second gap G2. A third gap G3 is formed between the bus electrodes. In one embodiment, the second gap G2 is longer than the first gap G1, and the third gap G3 is longer than the second gap G2.

In one embodiment, the first gap G1 is formed to be in the range of 50 to 80 μm. The second gap G2 can be formed between the centers of the opposite end portions of the extension electrodes, and can be in the range of 75 to 120 μm. In one embodiment, the third gap G3 is in the range of 500 to 800 μm. The first gap G1, the second gap G2, and the third gap G3 can be also formed to have a ratio of G1:G2=1:1.5 and G1:G3=1:10.

Each of the extension electrodes becomes narrower further from the center of the discharge cells. Furthermore, the barrier ribs arranged in the space between the first substrate and the second substrate can define non-discharge regions in addition to the plurality of discharge cells, and the non-discharge region can be formed in an area encompassed by discharge cell abscissas that pass through centers of adjacent discharge cells and discharge cell ordinates that pass through centers of adjacent discharge cells in a direction that intersects the direction of the abscissas.

A non-discharge region can be formed to have independent cell structures defined by the barrier ribs, and each of the discharge cells becomes narrower further from their centers.

The extension electrodes of a pair of display electrodes corresponding to each of the discharge cells form different gaps G1 and G2 from each other. The optimum values for these gaps can be determined together with the gap G3 between the bus electrodes to improve the discharge efficiency.

DETAILED DESCRIPTION

Figure 1:
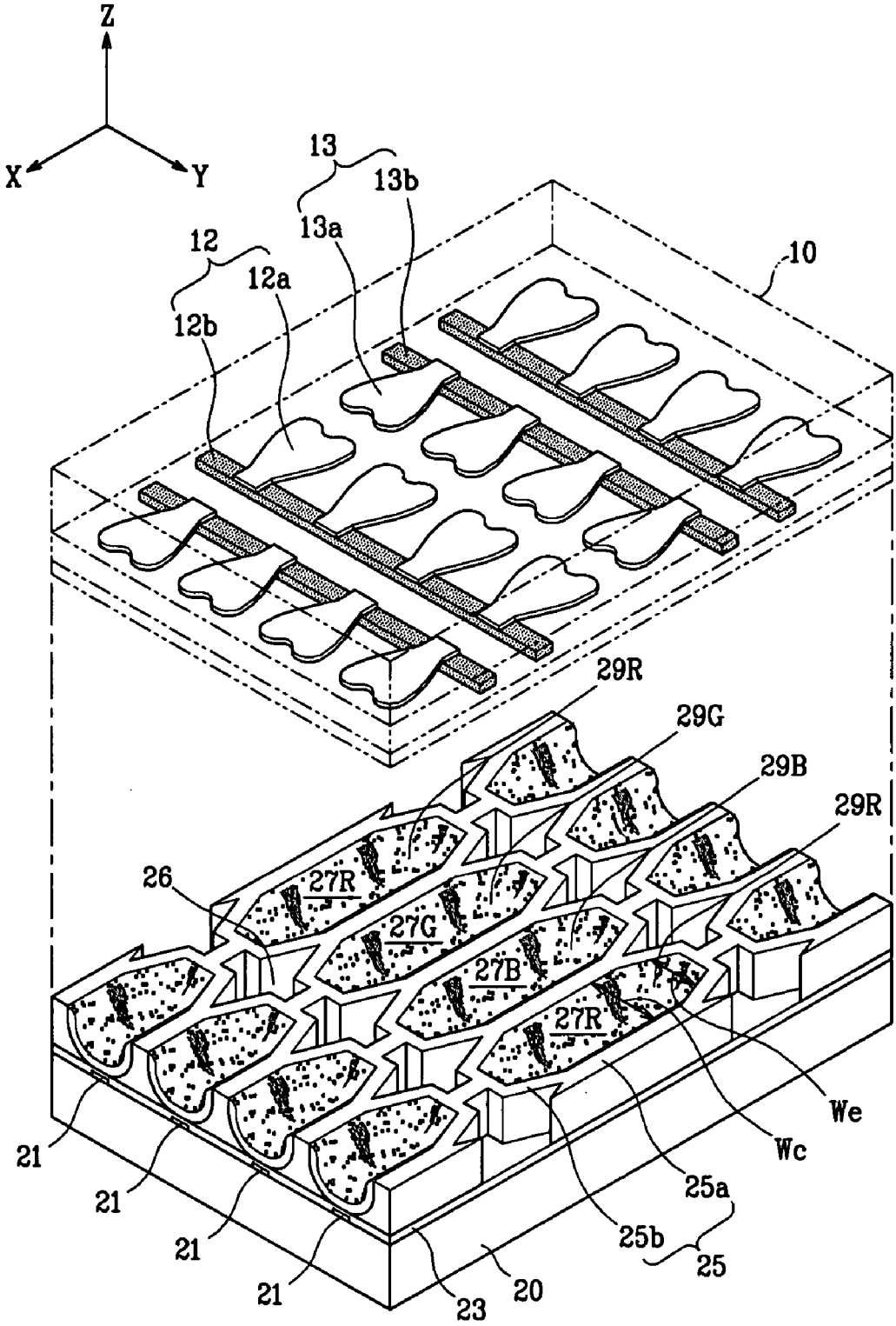
FIG. 1 is a partial exploded perspective view of a PDP according to one embodiment of the present invention.
Figure 2:
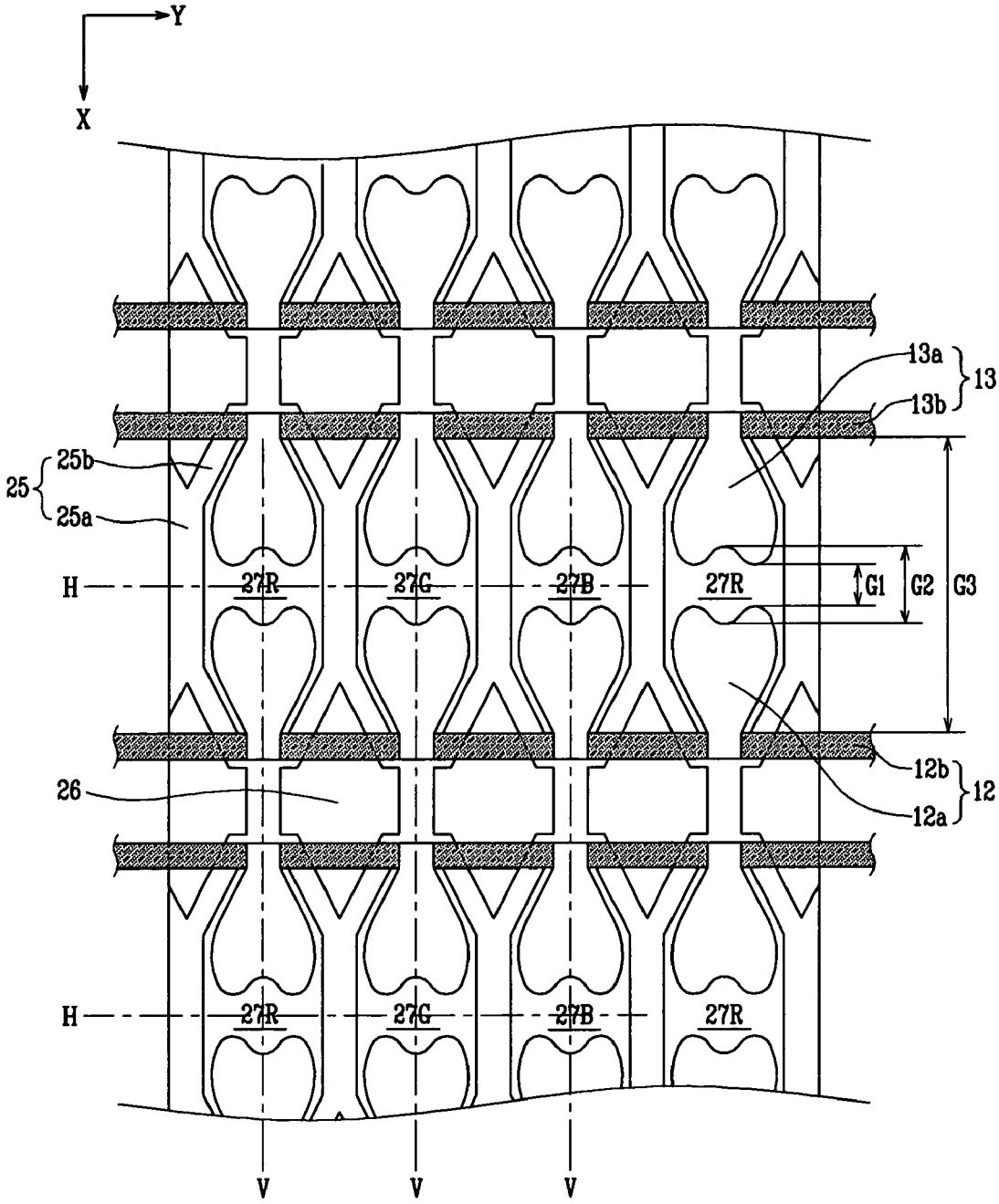
FIG. 2 is a partial plan view of the PDP according to one embodiment of the present invention.

As shown in FIGS. 1-2, the plasma display panel according to one embodiment of the present invention is generally formed with a first substrate 10 and a second substrate 20 which are spaced at a predetermined distance while facing each other. In the space between both of the substrates 10, 20, a plurality of discharge cells 27R, 27G, 27B are defined by barrier ribs to cause a plasma discharge. Display electrodes 12, 13 and address electrodes 21 are formed on the first substrate 10 and the second substrate 20, respectively.

A plurality of the address electrodes 21 are formed along one direction (the X-axis direction, as shown) of the second substrate 20 on a surface of the second substrate 20 opposing the first substrate 10. The address electrodes 21 are formed in a stripe pattern and spaced apart from the adjacent address electrodes 21 at a predetermined distance and parallel to one another. A dielectric layer 23 is also formed on the second substrate 20 where the address electrodes 21 are provided. The dielectric layer 23 is formed on an entire surface of the substrate covering the address electrodes 21. It should be noted that, although the address electrodes of the stripe type are mentioned above, the type of the address electrodes is not limited to this pattern and may be formed in various ways.

Barrier ribs 25 are arranged in the space between the first substrate 10 and the second substrate 20 to define a plurality of discharge cells 27R, 27G, 27B and non-discharge regions 26. Preferably, the barrier ribs 25 are established on the top surface of the dielectric layer 23 formed on the second substrate 20. The discharge cells 27R, 27G, 27B designate areas in which discharge gas is provided and where gas discharge is expected to take place with the application of an address voltage and a discharge sustain voltage. The non-discharge region 26 is an area where a voltage is not applied so that gas discharge, i.e. illumination, is not expected to take place therein. It is preferable that the non-discharge region 26 is formed to have a region with a width which is greater than the width of the top portion of the barrier ribs 25.

The non-discharge region 26 defined by the barrier ribs 25 is formed in an area encompassed by discharge cell abscissas H and ordinates V that pass through centers of each of the discharge cells 27R, 27G, 27B and that are respectively aligned with direction Y and direction X. In one embodiment, non-discharge region 26 is centered between adjacent abscissas H and adjacent ordinates V. Stated differently, in one embodiment, each pair of discharge cells 27R, 27G, 27B adjacent to one another along direction X has a common non-discharge region 26 with another such pair of discharge cells 27R, 27G, 27B adjacent along direction Y. The non-discharge region 26 of the present invention is formed to have an independent cell structure respectively by the barrier ribs 25.

The discharge cells 27R, 27G, 27B are formed to share at least one barrier rib with the adjacent one in the direction of the display electrodes 12, 13, and they are formed to accommodate the widths of both end portions thereof (in the direction of the display electrode, i.e. in the Y-axis direction of the drawing) placed in the direction of the address electrodes (in the X-axis direction of the drawing) becoming narrower further from the center of the discharge cells 27R, 27G, 27B. That is, with reference to FIG. 1, the width Wc at the center of the discharge cell 27R, 27G, 27B is greater than the width We at the end portion, and the width We at the end portion becomes narrower as it is further from the center of the discharge cells 27R, 27G, 27B. Both end portions of the discharge cell 27R, 27G, 27B in the direction of the address electrode 21 of the present embodiment form the shape of trapezoid, and accordingly, the overall plan shape of each of the discharge cells 27R, 27G, 27B is octagonal.

Red (R), green (G) and blue (B) phosphors are coated respectively within the inside of the discharge cells 27R, 27G, 27B to form phosphor layers 29R, 29G, 29B.

The display electrodes 12, 13 formed on the first substrate 10 are formed with bus electrodes 12*b*, 13*b* arranged in a corresponding pair within each of the discharge cells 27R, 27G, 27B along the direction (in the Y-axis direction of the drawing) intersecting the direction of the address electrodes 21. Each the display electrodes 12, 13 also has a pair of extension electrodes 12*a*, 13*a* extending from the bus electrodes 12*b*, 13*b* into the inside of each of the discharge cells towards each other to form an opposing pair. The extension electrodes 12*a*, 13*a* have a role in causing plasma discharge within the discharge cells 27R, 27G, 27B, and they may be formed with Indium Tin Oxide (ITO) of a transparent electrode in order to obtain a desired brightness. However, they are not limited thereto so that they can be formed with an opaque electrode like metal electrodes.

A pair of the display electrodes 12, 13 corresponding to each of the discharge cells 27R, 27G, 27B forms a first gap G1 and a second gap G2 having different distances from each other between the extension electrodes 12*a*, 13*a* opposing each other, and forms a third gap G3 between the bus electrodes 12*b*, 13*b*. The second gap G2 is longer than the first gap G1, and the third gap G3 is longer than the second gap G2. As shown in FIG. 2, the extension electrodes 12*a*, 13*a* each have a concave portion in the center of the end portion thereof, and convex portions are formed in both sides of the concave portion. Accordingly, the first gap G1 (a short gap) is formed where the convex portions of a pair of the extension electrodes 12*a*, 13*a* oppose each other, and the second gap G2 (a long gap) is formed where the concave portions thereof oppose each other. The main discharge starts from the first gap G1, and is spread out over the second gap G2, and thereby the discharge is diffused into the entire discharge cells 27R, 27G, 27B.

Since the first gap G1 of the extension electrodes 12*a*, 13*a* enables closing of the distance between the ends of the opposing extension electrodes 12*a*, 13*a* without deterioration of the aperture ratio, the voltage necessary for discharge can be lowered. The second gap G2 has a role in stably discharging by concentrating the discharge at the center thereof.

The gap necessary for starting the discharge is designed to lower the breakdown voltage, and the other electrode gaps are designed to improve the efficiency. That is, a significant factor for the first gap G1 is the lowest breakdown voltage and a significant factor for the second gap G2 and the third gap G3 is the improvement of the discharge efficiency.

Each of the extension electrodes 12*a*, 13*a* is formed to accommodate the width in the direction of the bus electrodes 12*b*, 13*b* (in the Y-axis direction in the drawing) becoming narrower as a back end portion thereof adjacent to the bus electrodes 12*b*, 13*b* is further from the center of the discharge cells 27R, 27G, 27B. Since the portion where the extension electrodes 12*a*, 13*a* are connected to the bus electrodes 12*b*, 13*b* makes little contribution to the discharge efficiency, the width thereof can be formed to be narrower than that of the ends to improve the discharge efficiency and to secure the aperture ratio.

Determination of the optimum values for the three gaps G1, G2, G3 formed by a pair of display electrodes 12, 13 corresponding each of the discharge cells 27R, 27G, 27B will now be described.

Figure 3:
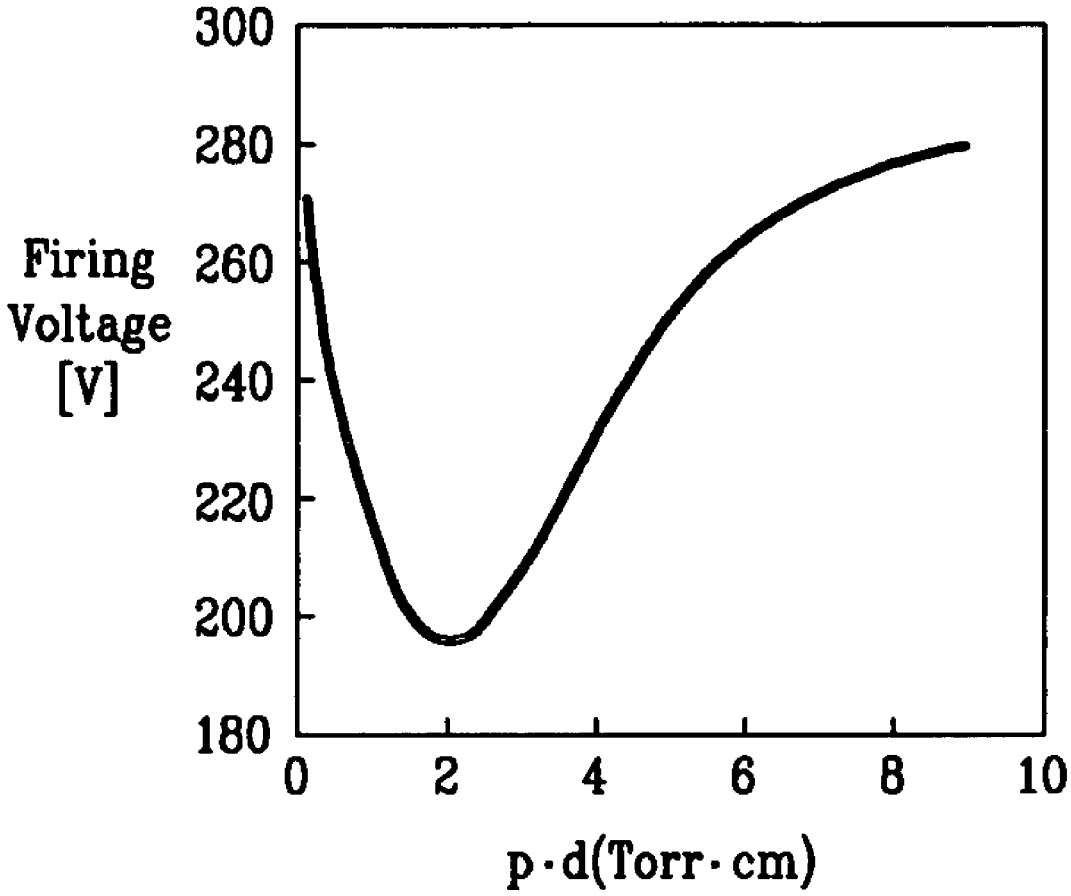
FIG. 3 is a graph showing the relationship between the firing voltage Vf and p·d in the first gap G1, where p is the discharge gas pressure and d is the distance between the electrodes.

With reference to FIG. 3, to obtain low firing voltage Vf the p·d value in the first gap is about from 2 to 4.8 Torr·cm. Since the discharge gas pressure is typically from 400 to 600 Torr, the first gap G1 is formed to be in the range of 50 to 80 μm.

The second gap G2 is longer than the first gap G1. As the second gap G2 is increased from the value of the first gap G, the efficiency is gradually increased. Although the discharge is diffused around the edge after the start of the discharge and the discharge itself is decreased, restriction of the discharge current increases its effect. That is, since the discharge efficiency is directly proportional to the brightness and inversely proportional to the active power dissipation, the restriction of discharge current means that the active power dissipation is decreased and the discharge efficiency inversely proportional to it is increased.

Figure 4A:
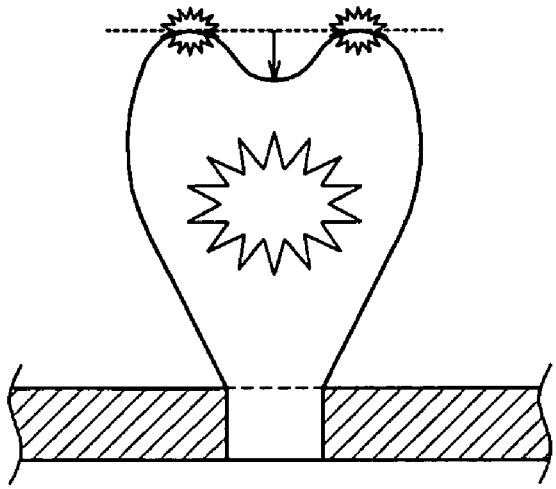
FIG. 4*a* is a drawing of a PDP extension electrode according to one embodiment of the present invention.
Figure 4B:
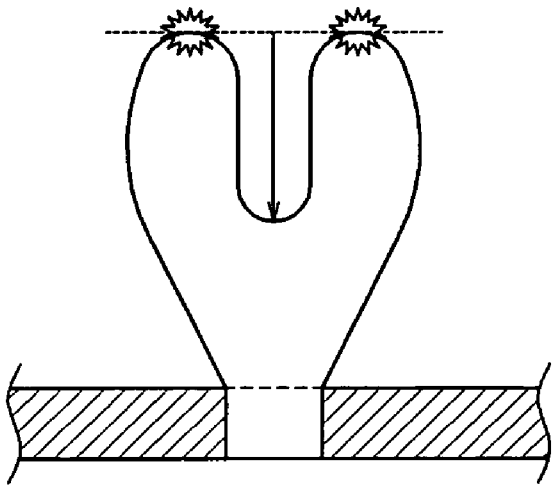
FIG. 4*b* is a drawing of a PDP extension electrode with an excessive concave portion according to one embodiment of the present invention.

If the value of the second gap G2 is increased to exceed a certain value (the maximum value for the efficiency of the second gap), however, the discharge efficiency is decreased. This is because the discharge itself is weakened and a sufficient diffusion of the discharge does not occur. That is, as shown in FIG. 4*a*, when the concave portion forming the second gap G2 is properly formed, it effectively diffuses the discharge. However, as shown in FIG. 4*b*, if the concave portion is excessively increased, the discharge starting from the first gap G1 cannot be smoothly diffused to the second gap G2.

Figure 5:
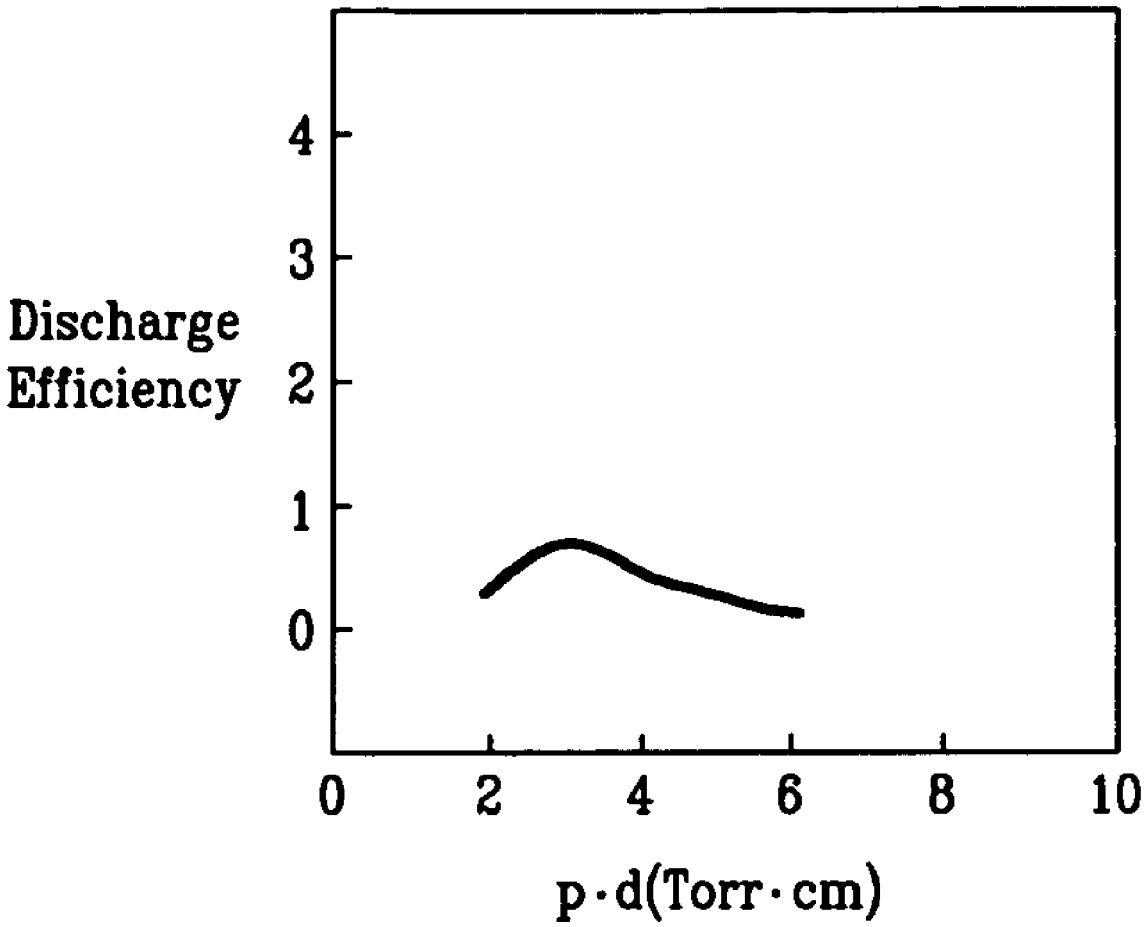
FIG. 5 is a graph showing the relationship between the emission efficiency and p·d in the second gap G2.

FIG. 5 is a graph showing the relationship between the emission efficiency and p·d in the second gap G2, where p is the discharge gas pressure and d is the distance between the electrodes. To obtain proper efficiency, the p·d value in the second gap G2 is about from 2.8 to 7.2 Torr·cm. Since the discharge gas pressure is usually from 400 to 600 Torr, the second gap G2 is formed to be in the range of 75 to 120 μm. This is one and a half times longer than the first gap G1.

Figure 6A:
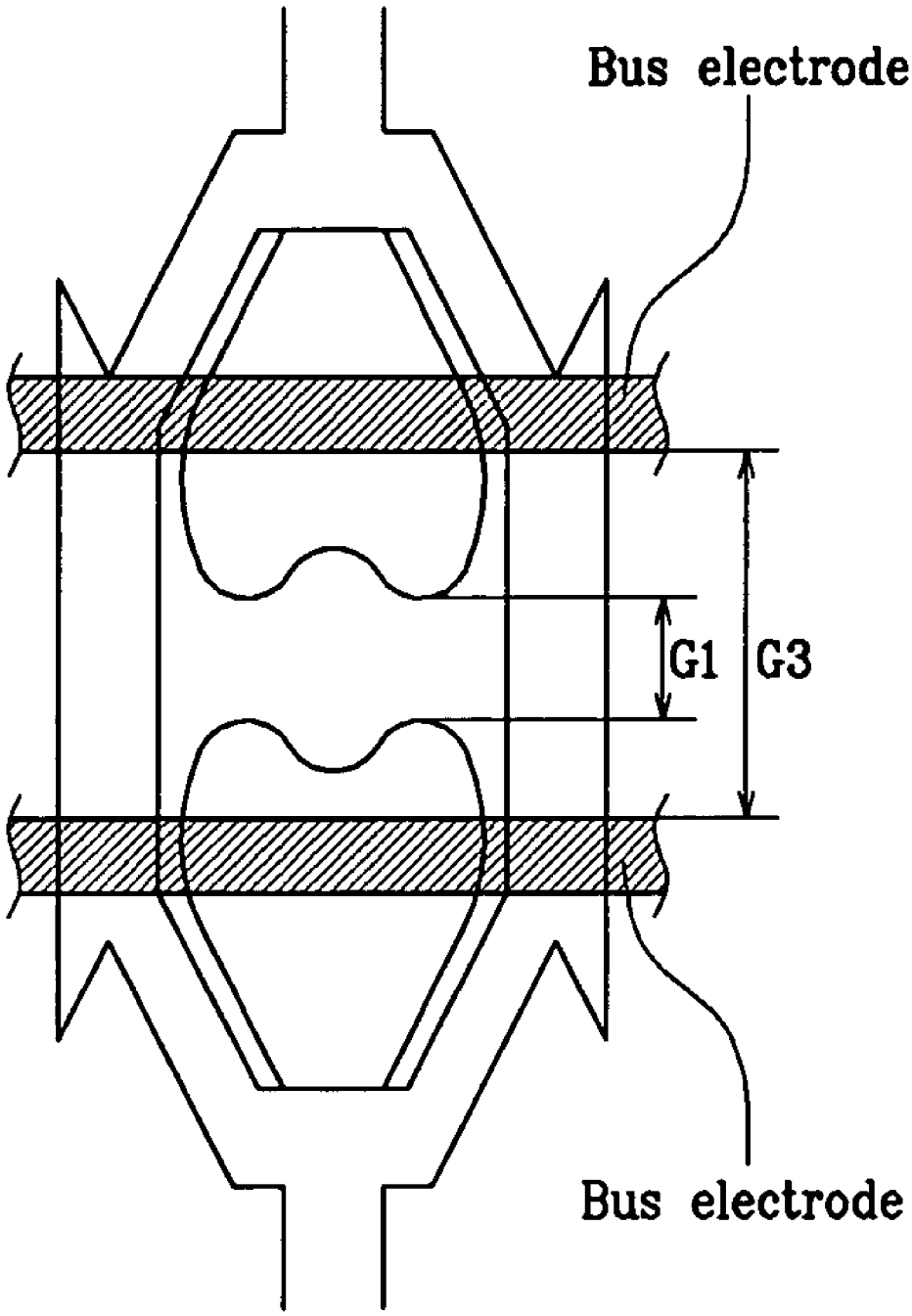
FIGS. 6*a*, 6*b*, and 6*c* are plan views of a PDP with varying the length of the third gap G3 between the bus electrodes within a discharge cell.
Figure 6B:
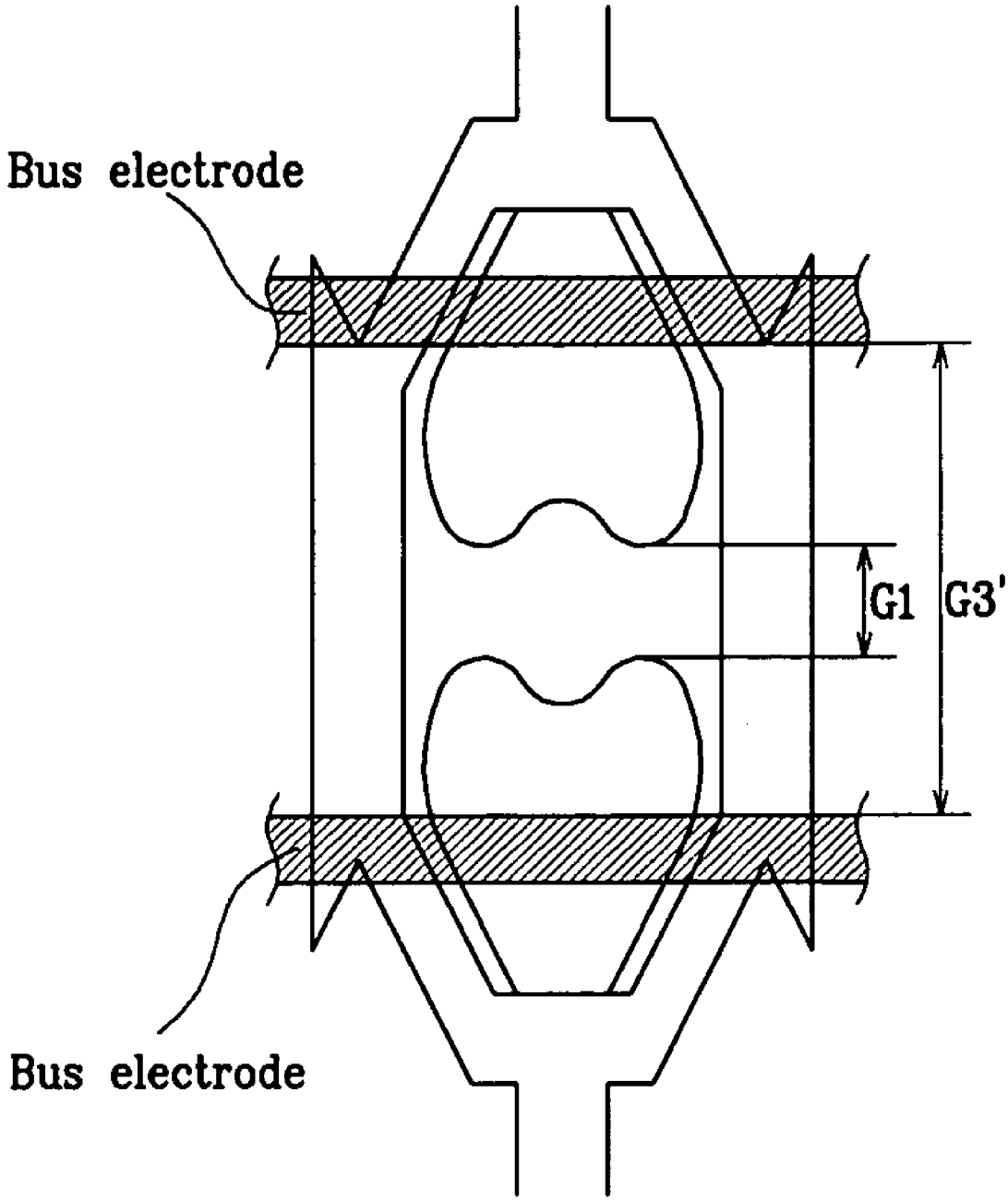
Figure 6C:
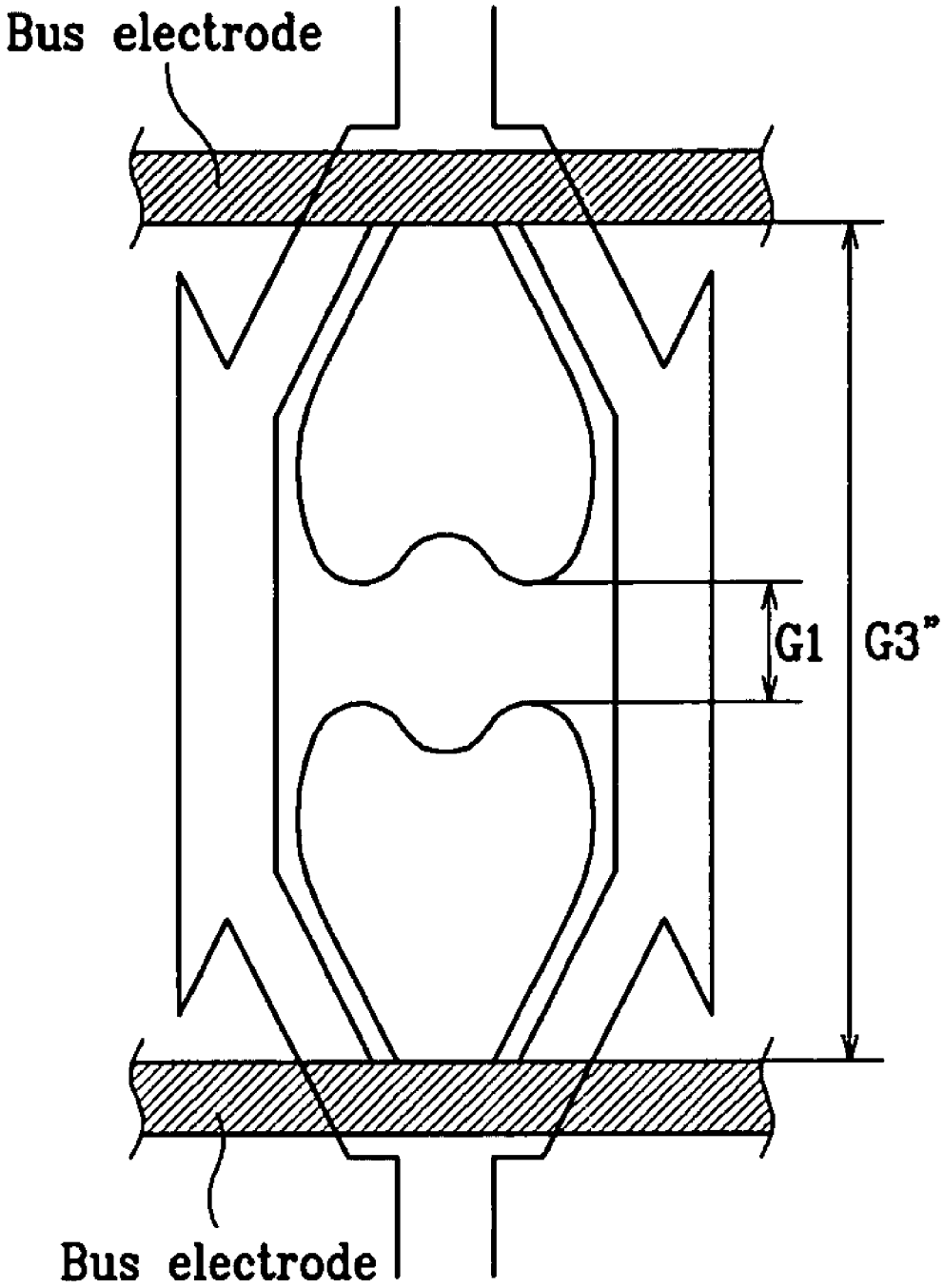

FIGS. 6*a*, 6*b*, and 6*c* are plan views of a PDP with varying lengths of the third gap G3 due to positioning of the bus electrodes within a discharge cell. If the third gap G3 is short, as shown in FIG. 6*a*, the distance from the bus electrodes to the first gap G1 is decreased, thereby reducing the voltage drop. However, since the opaque bus electrodes are positioned where light intensity is high, a large amount of light is shielded, thereby deteriorating the brightness.

If the bus electrodes are positioned as shown in FIG. 6*b*, increasing the third gap to third gap G3', the voltage drop can be slightly increased. However, since the bus electrodes are positioned where light intensity is low, less amount of light is shielded, thereby increasing the efficiency. If the third gap continues to increase to G3" so that the bus electrodes are positioned at the upper portion of the barrier ribs, the bus electrodes do not shield light emitted from the discharge cells at all, and thereby the aperture ratio of the discharge cell is increased to improve the brightness. In addition, since the bus electrodes with low resistance are positioned at the upper portion of the barrier ribs, the discharge current restriction is relatively increased, thereby improving the efficiency.

Figure 7:
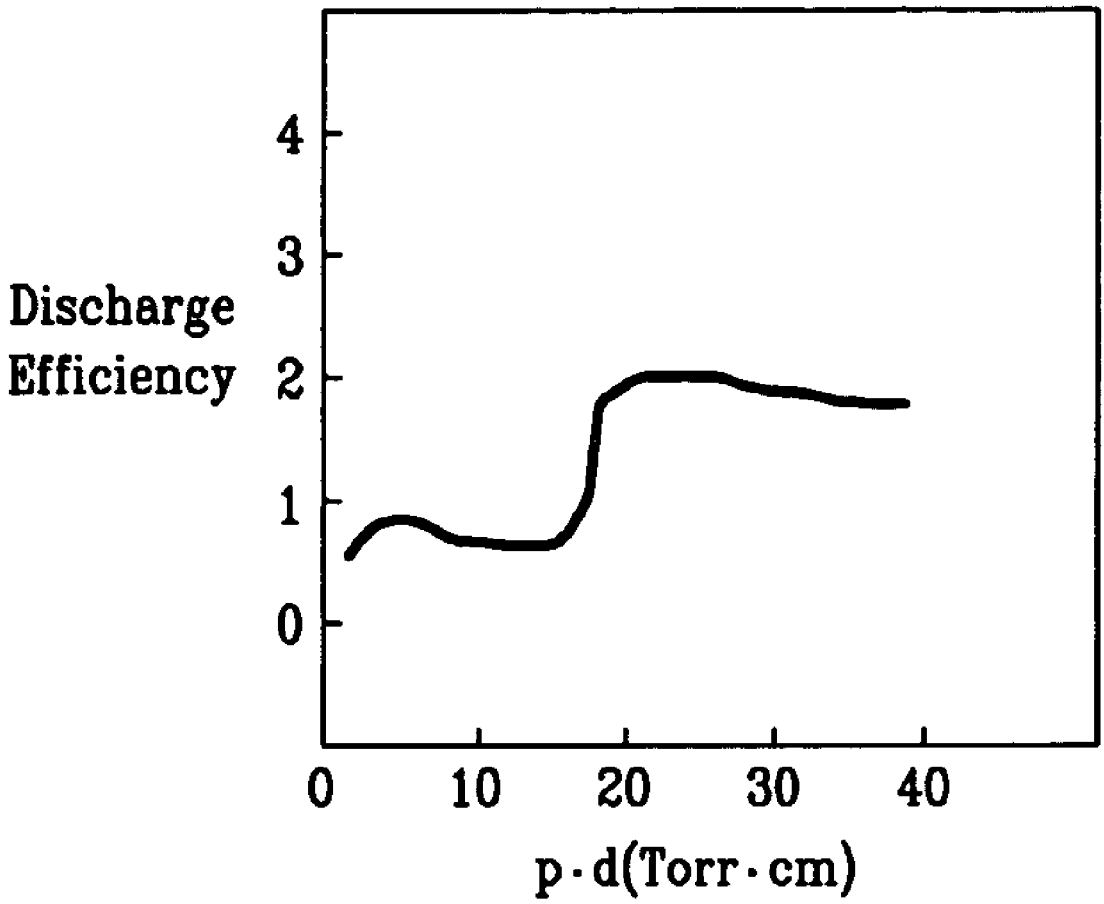
FIG. 7 is a graph showing the relationship between the emission efficiency and p·d in the third gap G3.
Figure 8:
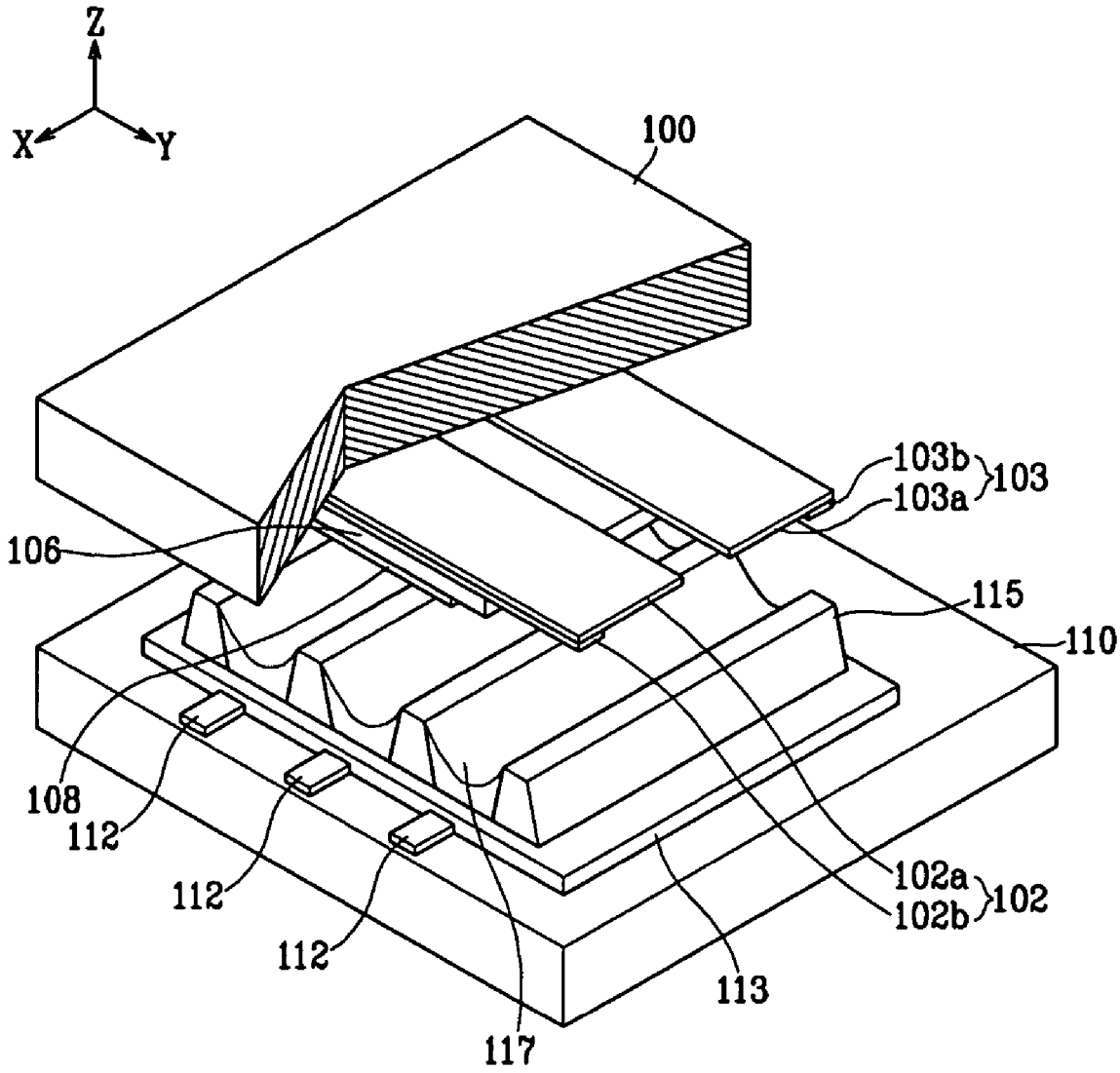
FIG.8(Prior Art)
FIG. 8 is a partial exploded perspective view of a conventional PDP.
Figure 9:
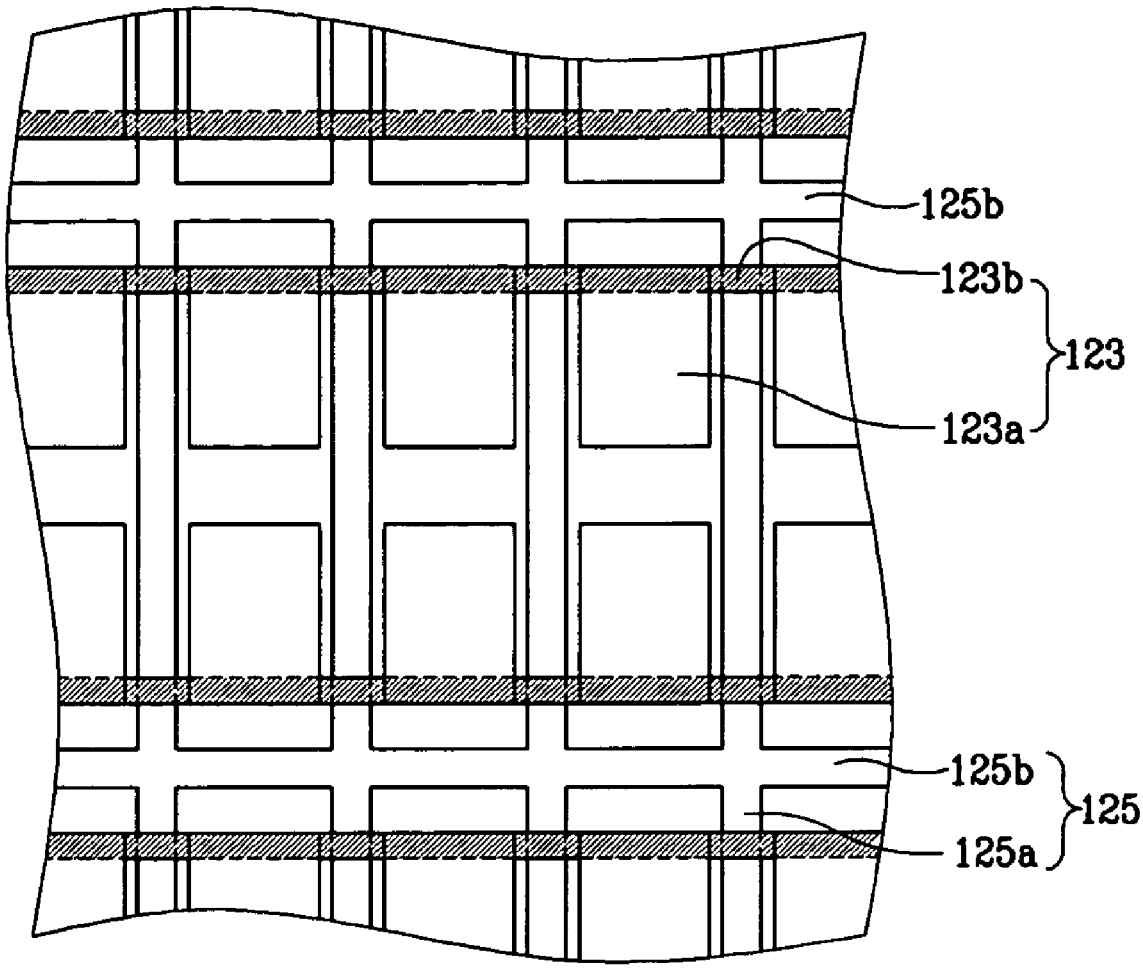
FIG. 9(Prior Art)
FIG. 9 is a plan view of a conventional PDP with structure extension electrodes and matrix type barrier ribs.
Figure 10:
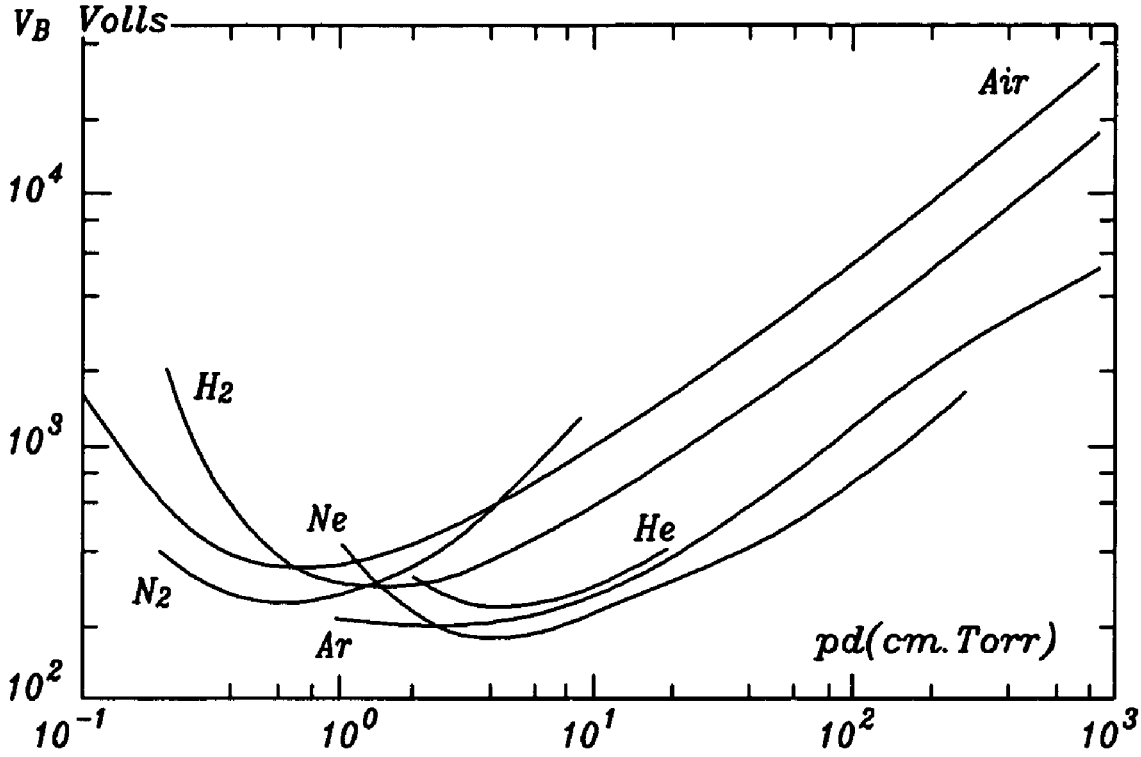
FIG. 10(Prior Art)
FIG. 10 is a Paschen curve graph showing the relationship between the breakdown voltage and p·d for various gases.
Figure 11A:
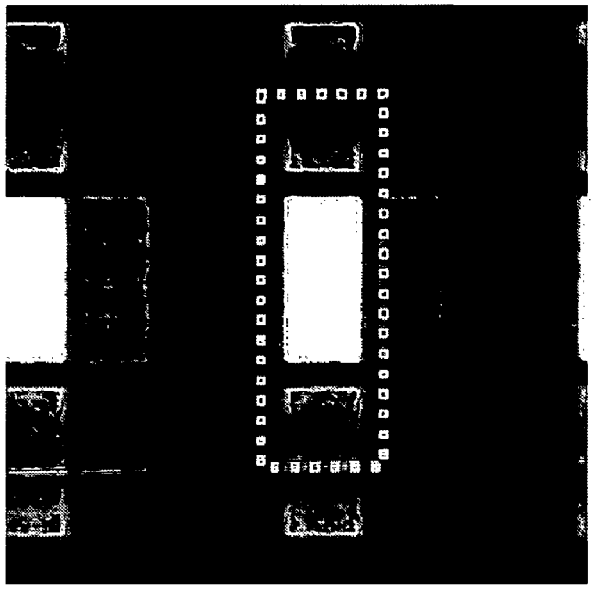
FIG. 11A(Prior Art)
FIG. 11*a* is an image for discharge cells of a conventional PDP.
Figure 11B:
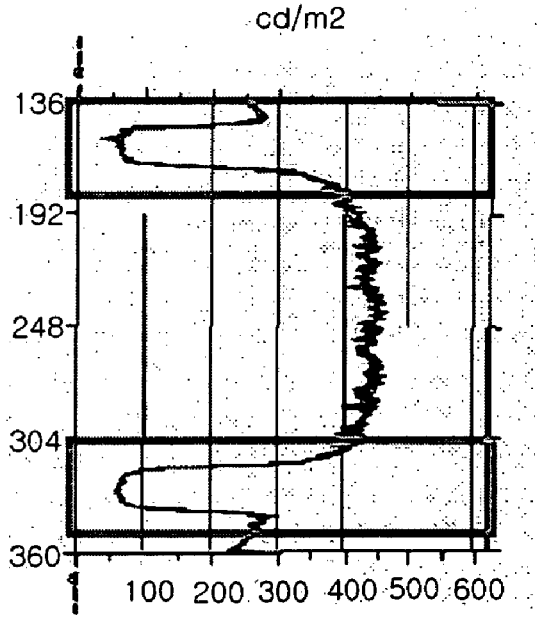
FIG. 11B(Prior Art)
FIG. 11*b* is a light profile for sustain discharge of a conventional PDP.

FIG. 7 is a graph showing the relationship between the emission efficiency and p·d in the third gap G3, where p is the discharge gas pressure and d is the distance between the electrodes. To obtain good efficiency, the p·d value in the third gap G3 is about 20 to 48 Torr·cm. Since the discharge gas pressure is typically 400 to 600 Torr, the third gap G3 is in the range of 500 to 800 μm. This is ten times longer than the first gap G1.

As described above, the most optimum efficiency can be achieved when the first gap G1 and the second gap G2 formed between the extension electrodes 12*a*, 13*a* of the opposite display electrodes 12, 13, and the third gap G3 formed between the bus electrodes 12*b*, 13*b* are designed to have a ratio of G1:G2=1:1.5, and G1:G3=1:10.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel comprising:

a first substrate and a second substrate opposing each other;

address electrodes extending in a first direction on the second substrate;

barrier ribs arranged in the space between the first substrate and the second substrate to define a plurality of discharge cells;

phosphor layers in the discharge cells (27R, 27G, 27B); and display electrodes on the first substrate, the display electrodes having bus electrodes extending in a second direction crossing the first direction to form a corresponding pair of the display electrodes corresponding to each of the discharge cells (27R, 27G, 27B), and extension electrodes individually extending from the bus electrodes to each of the discharge cells (27R, 27G, 27B) to form an opposing pair of the extension electrodes, wherein a pair of the display electrodes corresponding to each of the discharge cells (27R, 27G, 27B) forms a first gap and a second gap having different distances from each other between the extension electrodes opposing each other, and forms a third gap between the bus electrodes, wherein the second gap is longer than the first gap, and the third gap is longer than the second gap, wherein the barrier ribs further define a plurality of non-discharge regions, wherein at least two of the discharge cells (27R, 27G, 27B) adjacent to one another in the first direction has a common non-discharge region of the plurality of non-discharge regions with another at least two of the discharge cells (27R, 27G, 27B) adjacent to one another in the second direction, and wherein at least two adjacent non-discharge regions of the plurality of non-discharge regions share a common barrier rib of the barrier ribs, the at least two adjacent non-discharge regions being adjacent along the second direction, the common barrier rib extending in the first direction.

2. The plasma display panel of claim 1, wherein the first gap is formed to be in the range of 50 to 80 μm.

3. The plasma display panel of claim 1, wherein the second gap is formed between the centers of the opposite end portions of the extension electrodes.

4. The plasma display panel of claim 1, wherein the second gap is formed to be in the range of 75 to 120 μm.

5. The plasma display panel of claim 1, wherein each of the extension electrodes has a width in the second direction of the bus electrode that gradually narrows as it is further from the center of the discharge cells (27R, 27G, 27B).

6. The plasma display panel of claim 1, wherein the third gap is formed to be in the range of 500 to 800 μm.

7. The plasma display panel of claim 1, wherein the first gap, the second gap, and the third gap are formed to have a ratio of first gap:second gap:third gap=1:1.5:10.

8. The plasma display panel of claim 1, wherein the first gap is formed such that the discharge gas pressure p times the distance d between the electrodes is in the range of 2 to 4.8 Torr·cm.

9. The plasma display panel of claim 1, wherein the second gap is formed such that the discharge gas pressure p times the distance d between the electrodes is in the range of 2.8 to 7.2 Torr·cm.

10. The plasma display panel of claim 1, wherein the third gap is formed such that the discharge gas pressure p times the distance d between the electrodes is in the range of 20 to 48 Torr·cm,

11. The plasma display panel of claim 1, wherein each of the extension electrodes is formed with a transparent electrode.

12. The plasma display panel of claim 1, wherein each of the non-discharge regions is defined by the barrier ribs in an area encompassed by a pair of adjacent discharge cell abscissas that pass through centers of adjacent discharge cells (27R, 27G, 27B) in the second direction and a pair of adjacent discharge cell ordinates that pass through centers of adjacent discharge cells (27R, 27G, 27B) in the first direction that intersects the second direction.

13. The plasma display panel of claim 12, wherein the non-discharge region is formed to have independent cell structures defined by the barrier ribs.

14. The plasma display panel of claim 12, wherein each of the discharge cells (27R, 27G, 27B) has a width in the second direction of the bus electrode that gradually narrows away from the center of the discharge cells (27R, 27G, 27B).

15. The plasma display panel of claim 12, wherein the first gap is formed to be in the range of 50 to 80 μm.

16. The plasma display panel of claim 12, wherein the second gap is formed between the centers of opposite end portions of the extension electrodes.

17. The plasma display panel of claim 12 or claim 16, wherein the second gap is formed to be in the range of 75 to 120 μm.

18. The plasma display panel of claim 12, wherein each of the extension electrodes has a width in the direction of the bus electrode that narrows further from the center of the discharge cells (27R, 27G, 27B).

19. The plasma display panel of claim 12, wherein the third gap is formed to be in the range of 500 to 800 μm.

20. The plasma display panel of claim 12, wherein the first gap, the second gap, and the third gap are formed to have a ratio of first gap:second gap:third gap=1:1.5:10.

21. A plasma display panel comprising:

a first substrate and a second substrate opposing each other;

address electrodes extending in a first direction on the second substrate;

barrier ribs arranged in the space between the first substrate and the second substrate to define a plurality of discharge cells (27R, 27G, 27B);

phosphor layers in the discharge cells (27R, 27G, 27B); and display electrodes on the first substrate, the display electrodes having bus electrodes extending in a second direction crossing the first direction to form a corresponding pair of the display electrodes corresponding to each of the discharge cells (27R, 27G, 27B), and transparent extension electrodes individually extending from the bus electrodes to each of the discharge cells (27R, 27G, 27B) to form an opposing pair of the transparent extension electrodes, wherein a pair of the display electrodes corresponding to each of the discharge cells (27R, 27G, 27B) forms a first gap and a second gap having different distances from each other between the transparent extension electrodes opposing each other, and forms a third gap between the bus electrodes, wherein the second gap is longer than the first gap, and the third gap is longer than the second gap, wherein the barrier fibs further define a plurality of non-discharge regions, wherein at least two of the discharge cells (27R, 27G, 27B) adjacent to one another in the first direction has a common non-discharge region of the plurality of non-discharge regions with another at least two of the discharge cells (27R, 27G, 27B) adjacent to one another in the second direction, and wherein at least two adjacent non-discharge regions of the plurality of non-discharge regions share a common baffler rib of the baffler ribs, the at least two adjacent non-discharge regions being adjacent along the second direction, the common baffler rib extending in the first direction.

* * * * *

UNITED STATES PATENT AND TRADEMARK OFFICE

CERTIFICATE OF CORRECTION

PATENT NO. : 7,683,545 B2
APPLICATION NO. : 10/999231
DATED : March 23, 2010
INVENTOR(S) : Jae-Ik Kwon et al.

It is certified that error appears in the above-identified patent and that said Letters Patent is hereby corrected as shown below:

In the Claims

| | |
|---|---|
| Column 10, Claim 21, line 1 | Delete "fibs"<br>Insert -- ribs -- |
| Column 10, Claim 21, lines 10 and 11 | After "common"<br>Delete "baffler" and<br>Insert -- barrier -- |
| Column 10, Claim 21, line 11 | Before "ribs"<br>Delete "baffler" and<br>Insert -- barrier -- |
| Column 10, Claim 21, line 13 | Delete "baffler"<br>Insert -- barrier -- |

Signed and Sealed this
Sixteenth Day of August, 2011

David J. Kappos

David J. Kappos
*Director of the United States Patent and Trademark Office*